United States Patent [19]

Davis

[11] 4,057,748

[45] Nov. 8, 1977

[54] TRAVELLING WAVE TUBES

[75] Inventor: Peter Robert Davis, Chelmsford, England

[73] Assignee: English Electric Valve Company Ltd., England

[21] Appl. No.: 658,827

[22] Filed: Feb. 17, 1976

[30] Foreign Application Priority Data

Mar. 8, 1975 United Kingdom ..... 9908/75

[51] Int. Cl.[2] ..... H01J 25/34

[52] U.S. Cl. ..... 315/3.5; 315/3.6; 315/5.35

[58] Field of Search ..... 315/3.5, 5.35, 3.6, 315/39.3

[56] References Cited

U.S. PATENT DOCUMENTS

| | | | |
|---|---|---|---|
| 2,305,884 | 12/1942 | Litton | 315/5.35 |
| 2,741,718 | 4/1956 | Wang | 315/3.5 |
| 2,971,113 | 2/1961 | Nygard | 315/3.5 |
| 3,324,339 | 6/1967 | Winslow et al. | 315/5.35 X |
| 3,398,315 | 8/1968 | Washburn | 315/3.5 |
| 3,602,766 | 8/1971 | Grant | 315/3.5 |
| 3,684,914 | 8/1972 | Purnell | 315/5.35 |
| 3,885,192 | 5/1975 | Esterson | 315/5.35 |

*Primary Examiner*—Saxfield Chatmon, Jr.
*Attorney, Agent, or Firm*—Diller, Brown, Ramik & Wight

[57] ABSTRACT

A travelling wave tube having a periodic permanent magnetic focusing structure is provided with ferromagnetic plates having copper inserts which conduct heat away from the electron beam path and reduce the formation of hot spots.

9 Claims, 3 Drawing Figures

TRAVELLING WAVE TUBES

Figure 1:
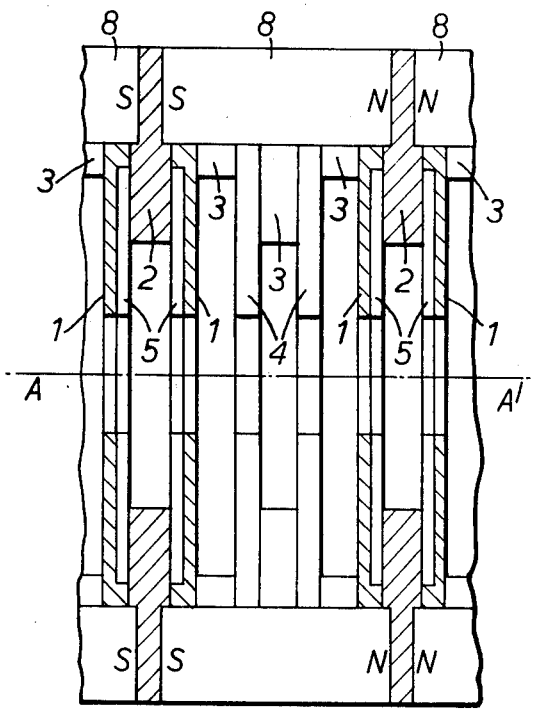

This invention relates to travelling wave tubes and is concerned with improvements in or modifications to the invention which is the subject of our co-pending parent patent application Ser. No. 442,884, now U.S. Pat. No. 3,885,192.

According to the parent invention a coupled cavity travelling wave tube includes a stack of apertured plates assembled to provide a plurality of successive coupled cavities coupled for the fundamental mode of operation; a magnetic pole piece provided at each *n*th cavity (where *n* is an interger of 2 or greater) which pole piece consists of an apertured plate made of ferromagnetic material and positioned between a pair of thinner apertured plates which also consist of ferromagnetic material and which have regions extending the ferromagnetic path, provided by the first mentioned apertured plate, close to the electron beam path of the tube, each pair of said thinner apertured plates being spaced apart from each other by the thickness of the first mentioned apertured plate to define a cavity between them; and a periodic permanent magnetic focusing structure surrounding said cavities and consisting of ring shaped magnets which provide permanent magnetic fields through said pole pieces to said electron beam path.

According to this invention a fundamental coupled cavity travelling wave tube includes a stack of apertured plates assembled to provide a plurality of successive coupled cavities for the fundamental mode of operation; and a periodic permanent magnetic focusing structure surrounding said cavities and consisting of ring shaped magnets which provide permanent magnetic fields to the electron beam path of the tube through selected ferromagnetic ones of the stack of apertured plates which are provided with copper portions (5) adjacent said beam path (AA') to conduct heat away therefrom.

Preferably said copper portions are in good thermal and electrical contact over the whole of the interface with the ferromagnetic apertured plates. Preferably again the good thermal and electrical contact is achieved by brazing the copper portions to the ferromagnetic apertured plates.

The use of the copper portions enables heat to be conducted away much more rapidly from the regions of the ferromagnetic apertured plates close to the electron beam path than would otherwise be the case. The risk of overheating at these regions can be a key factor in determining the maximum permissible power level at which the travelling wave tube can be operated, and the copper portions permit higher power levels to be adopted without damage.

Preferably the copper portions are so positioned in relation to each ferromagnetic plate as to be situated in an assentially magnetic field free region.

Preferably the ferromagnetic plates are composed of soft iron.

Preferably again each ferromagnetic plate is provided with a copper portion in the form of an annular copper member which completely surrounds the electron beam path.

Preferably yet again the annular copper members are inserts recessed into the ferromagnetic material so as not to extend the thickness thereof.

To preserve the symmetry of the electrical properties of the travelling wave tube the ferromagnetic plates (including the annular copper members which are recessed into them) are of the same thickness as other similarly apertured plates which are wholly copper, and the dimensions of which are dictated by the electrical coupling properties of the cavities which they constitute.

The ferromagnetic plates are provided with closed slots extending radially away from a central hole surrounding the electron beam path, and in such a case, preferably the annular copper inserts extend from the central hole to at least the outside diameter of the radial slots. The copper inserts are also provided with radial slots which align with the aforesaid radial slots.

Figure 2:
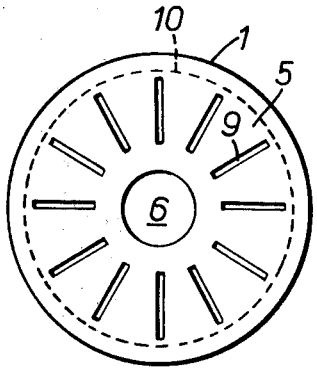
Figure 3:
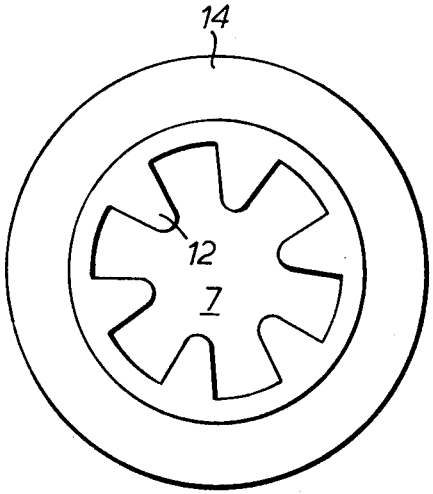

The invention is further described, by way of example, with reference to the accompanying drawing in which, FIG. 1 is a diagrammatic section view, taken on a centre line AA', showing one magnetic length of a permanent magnetic focusing arrangement in a travelling wave tube in accordance with the present invention, and FIGS. 2 and 3 show examples of the apertured plates forming the cavities of the travelling wave tube.

Referring to the drawing, a portion of a travelling wave tube consists of a stack of apertured plates 1, 2, 3, 4 which are assembled together to provide a succession of cavities coupled for the fundamental mode of operation. In FIG. 1 the plates which are shown cross-hatched are made of ferromagnetic material, usually soft iron and the unshaded plates are made wholly of copper. Each plate 1 which primarily consists of soft iron, is provided with a copper insert 5 — the radial extent of the insert is best seen from FIG. 2 in which the outer limit of the copper portion is shown as broken line 10. As can be seen the plates referenced 1 are each provided with a central hole 6 and radial slots 9, which extend through the copper inserts 5. The plates 4 are identical except that they are made wholly of copper — they are not separately shown in front view.

The soft iron plates referenced 2, are shown in FIG. 3 and are like the plates 3 which are made of copper, except that each is provided with a rim-like extension 14 which serves to locate cylindrical ringlike magnets 8. The plates 2 act as pole pieces for these magnets 8. Each is provided with a large central aperture 7 having six inward projections 12.

The plates with the radial slots 9 (i.e. plates 1 and 4) are arranged so that the slots 9 in successive plates align with each other. However the other apertured plates (i.e. plates 2 and 3) which are each provided with the six inward projections 12 are rotationally staggered (annularly offset) by 30° relative to the two adjacent similarly apertured plates 2 or 3.

The complete stack, which consists of many magnetic lengths of the kind shown in FIG. 1, is formed as a mechanical unit, to form with end members (not shown) a vacuum-tight structure, one end member carrying an axially positioned electron gun, and the other end member carrying an axially positioned electron collector.

As was pointed out in the parent U.S. Pat. No. 3,885,192, the plates 1 extend the magnetic field to the electron beam path of the tube. The plates 2 serve as pole pieces for the magnets 8, and their thickness is determined by the magnetic flux they are required to carry. The plates 1 are somewhat thinner, since the magnetic flux carried by them decreases with distance from the magnets 8. In practice the thickness of the rim-like extension 14 is at least two and a half times as thick as the thickest section of the plates 1 to prevent magnetic saturation. This kind of structure provides a very compact and light travelling wave tube.

In use an electron beam is projected along the centre of the travelling wave tube and its path corresponds to the line AA'. The ring magnets 8, which are alternately poled as shown, serve to focus this electron beam, and to counter-act its tendency to spread.

Although with this kind of permanent magnetic focusing arrangement, the electron beam can be accurately focused, the periodic nature of the magnetic field necessarily introduces periodic variations in the diameter of the electron beam. For this reason, and also possibly due to minor misalignments in the focusing arrangement, it is found that a small proportion of the electron beam impinges on the apertured plates 1 and 4. This can cause overheating, particularly when the travelling wave tube is operated at very high power levels and high current electron beams are used. The plates 4, which are wholly of copper, can safely dissipate the excess heat by conduction to the outer surface of the tube, but, as is known soft iron is not a particularly good thermal conductor. For this reason the plates 1 are each provided with the annular copper inserts 5, which conduct heat rapidly away from the central regions of the plates which are heated by the electron beam. The copper inserts 5 are provided on those faces of the plates 1 which are adjacent to the pole piece plates 2, and each insert 5 is in good electrical and thermal contact over the whole of the interface with the corresponding plate 1. This can be achieved by brazing the copper inserts to the plate 1. In this way the copper inserts are situated in essentially magnetic field free regions, and so do not modify the magnetic focusing properties of the travelling wave tube.

Each plate 1 and 4 may typically have an overall thickness of about 2 mm, and the thickness of the copper inserts is about half this (i.e. 1 mm). The copper inserts extend from the central beam hole 6 to just past the outside diameter of the slots. The extent of the copper inserts 5 is shown in FIG. 2 by the broken line 10. On the one hand the radial extent of the copper inserts should be sufficiently great in view of the heat conduction required, but on the other hand is limited by the need to provide a sufficiently thick plate of soft iron to carry without saturation the magnetic flux required to achieve good focusing.

I claim:

1. A fundamental coupled cavity travelling wave tube including a stack of apertured plates defining an electron beam path and assembled to provide a plurality of successive coupled cavities for the fundamental mode of operation in which a ferromagnetic plate is located at each end of each cavity and a plurality of non-magnetic plates are disposed therebetween, and a ferromagnetic pole piece is sandwiched between and contacted by each pair of ferromagnetic plates defining adjacent ends of adjacent cavities, and a periodic permanent magnetic focusing structure surrounding said cavities and consisting of a plurality of ring shaped magnets each of which is in magnetic contact with the pole pieces of an associated cavity, each pair of ferromagnetic plates projecting radially inwardly from the pole piece sandwiched therebetween to provide permanent fields extending into and surrounding the electron beam path of the tube, said ferromagnetic plates being provided with copper portions extending radially outwardly from adjacent said beam path to conduct heat away therefrom which is caused by electron beam impingement on such ferromagnetic plates.

2. A travelling wave tube as claimed in claim 1 wherin said copper portions are in intimate contact with their respective ferromagnetic plates plates to provide good thermal and electrical contact over the whole of their interface with the ferromagnetic apertured plates.

3. A travelling wave tube as claimed in claim 2 wherein the good thermal and electrical contact is achieved by brazing the copper portions to the ferromagnetic apertured plates.

4. A travelling wave tube as claimed in claim 1 wherein the copper portions are so positioned in relation to each ferromagnetic plate as to be situated in an essentially magnetic field free region.

5. A travelling wave tube as claimed in claim 1 wherein the ferromagnetic plates are composed of soft iron.

6. A travelling wave tube as claimed in claim 1 wherein each ferromagnetic plate is provided with a copper portion in the form of an annular copper member which completely surrounds the electron beam path.

7. A travelling wave tube as claimed in claim 6 wherein the annular copper members are inserts recessed into the ferromagnetic material so as to not to extend the thickness thereof.

8. A travelling wave tube as claimed in claim 1 in which the annular copper inserts extend from a central hole in the ferromagnetic plate to at least the outside diameter of radial slots formed in said ferromagnetic plates, the annular copper inserts also being provided with slots which align with said radial slots.

9. In a fundamental coupled cavity travelling wave tube which defines an evacuated, axially extending electron beam path, a stack of centrally apertured plates whose central apertures are centered on said electron beam path and are defined at least by portions closely spaced from and cumulatively surrounding said electron beam path, certain spaced ones of said plates defining pole pieces and having peripheral margins projecting radially beyond the remaining plates, a series of ring shaped magnets surrounding said remaining plates and sandwiching the peripheral margins of said pole pieces therebetween, said plates defining successive cavities therebetween which are coupled for the fundamental mode of operation, said pole pieces and those particular plates immediately adjacent thereto being formed of ferromagnetic material while all other plates are formed of copper and said particular plates immediately adjacent said pole pieces having circular central apertures whereby said particular plates may be subjected to electron beam impingement tending to create hot spots, and copper insert means in said particular plates extending from said central apertures thereof into partial overlapping relation to said pole pieces.

* * * * *